US006081929A

United States Patent [19]

Rothrock et al.

[11] Patent Number: 6,081,929

[45] Date of Patent: Jul. 4, 2000

[54] IMPACT PROTECTION HELMET WITH AIR EXTRACTION

[75] Inventors: Ed Rothrock, Whittier, Calif.; Kendall Merrill, Champaign, Ill.

[73] Assignee: Bell Sports, Inc., Rantoul, Ill.

[21] Appl. No.: 09/206,045

[22] Filed: Dec. 4, 1998

[51] Int. Cl.[7] ..... A42B 3/28

[52] U.S. Cl. ..... 2/171.3; 2/424

[58] Field of Search ..... 2/410, 411, 414, 2/422, 424, 171.3; 128/200.28, 201.22, 201.23, 201.24, 201.25, 206.25; 416/63

[56] References Cited

U.S. PATENT DOCUMENTS

| | | | |
|---|---|---|---|
| 3,822,698 | 7/1974 | Guy | 128/201.25 |
| 3,881,198 | 5/1975 | Waters | 2/171.3 |
| 3,963,021 | 6/1976 | Bancroft | 128/201.25 |
| 4,136,688 | 1/1979 | Gorman | 2/424 |
| 4,752,974 | 6/1988 | Haino . | |
| 4,852,562 | 8/1989 | Howie | 128/201.25 |
| 4,901,716 | 2/1990 | Stackhouse et al. . | |
| 5,035,239 | 7/1991 | Edwards . | |
| 5,054,480 | 10/1991 | Bare et al. . | |
| 5,113,853 | 5/1992 | Dickey . | |
| 5,123,114 | 6/1992 | Desanti . | |
| 5,193,347 | 3/1993 | Apisdorf . | |
| 5,283,914 | 2/1994 | James | 2/424 |
| 5,533,500 | 7/1996 | Her-Mou | 128/201.25 |
| 5,561,862 | 10/1996 | Flores, Sr. . | |
| 5,575,018 | 11/1996 | Rothrock . | |
| 5,592,936 | 1/1997 | Thomas, Jr. et al. . | |

*Primary Examiner*—Micheal A. Neas
*Attorney, Agent, or Firm*—Ladas & Parry

[57] ABSTRACT

A protective helmet having an impact-resistant outer shell with an impact liner disposed within. The impact liner encloses a substantial portion of a wearer's head. A fan assembly having at least one fan and preferably a fan cowling is disposed between the impact liner and the outer shell. In operation, the fan assembly is connected through a connecting assembly to a source of power. The connecting assembly may optionally include power conditioners. When connected, the fan assembly extracts air or other respiration gases from around a wearer's head, through channels in the impact liner, and exhausts it out of the helmet through vents. The vents and the outer shell feature covering the fan assembly are designed for shell integrity and resistance to impacts and entry by flames or foreign objects. A gas inlet connector may optionally be provided for connecting an external source of respiration gases to the helmet, as may ducting to guide such gas to a wearer's face for respiration.

25 Claims, 5 Drawing Sheets

IMPACT PROTECTION HELMET WITH AIR EXTRACTION

FIELD OF THE INVENTION

The present invention relates to protective head coverings, more particularly to protective head coverings providing transport for respiration and cooling gases, and is particularly well-suited to providing transport for respiration and cooling gases within visored and highly impact-protective helmets.

BACKGROUND

Helmets must be worn for a variety of reasons, under a variety of conditions. For example, helmets are utilized to contain respiration gases when it is desired to separate a worker from the environment. Such separation may be desired in manufacturing clean rooms and surgical operating rooms which should be protected from contamination by a worker's respiration, and in locations with an unpleasant or hazardous atmosphere from which the worker's respiration should be protected, as in the presence of toxic fumes or when firefighting. Safety helmets providing some impact protection are required in many jobs where a significant risk is perceived of objects striking a worker's head, including numerous construction, industrial, mining and firefighting jobs. Helmets providing even more impact protection than typical safety helmets are used in activities involving a significant risk of severe impact to the head, such as vehicle racing.

Wearing a helmet, particularly in a hot environment, is likely to make the worker's head even hotter, adding to the wearer's discomfort and fatigue, which will eventually impair performance. Driving some race cars has been likened to going to the office in an oven. Mines, construction and industrial sites are sometimes very hot, as are firefighting sites. The eventual degradation of performance from discomfort and fatigue adds to the dangers of injury. Accordingly, it is desirable to provide helmets which reduce discomfort to the wearer, thus enhancing comfort, reducing fatigue, and indirectly improving safety.

Various efforts have been made to deal with excessive heat around a helmet wearer's head For example, a helmet-mounted air conditioning system is described in U.S. Pat. No. 5,193,347 to Apisdorf. That apparatus includes a thermoelectric module (TEM), mounted in a housing on top of the helmet, which supplies cooled air to the area of the wearer's face. The externally-mounted air conditioner of this invention may interfere with objects near the wearer's head, or cause the helmet to balance somewhat awkwardly.

In hot racing cars, mines, or industrial environments, it may be advantageous to provide conditioned breathing gas to a helmet wearer. Conditioning might be primarily cooling the air, or filtering out particulates, or modifying the gas mixture by removing or adding water or special gases, or some combination of the foregoing. Headgear air-flow control systems are known which filter the incoming air. For example, U.S. Pat. No. 5,035,239 to Edwards describes a "powered respirator" including a helmet having an electric fan located at the rear inside of the helmet. The fan impels air into the helmet, through a bag filter and thence to the wearer's facial area. This design has been described as probably not complying with impact resistance safety standards due to the fan presence inside the helmet. A passive gas exit is provided near the wearer's mouth, and the air is not particularly circulated to cool the wearer's head.

U.S. Pat. No. 5,113,853 to Dickey describes another helmet with a filtered air supply. Like that described in U.S. Pat. No. 5,035,239, this helmet employs an electric fan to pull in external ambient air through a filter. The filtered air is impelled across the wearer's head and thereafter is guided toward the wearer's facial area for the wearer to breathe. This device positions an intake fan near the crown of the wearer's head, within a large aperture through the shell of the helmet located near the crown of the wearer's head opening, and has a cap covering the fan but well separated from the shell. This helmet is not believed to meet rigorous impact safety standards. Further, it obligates the wearer to breathe air only after traveling over wearer's head and possibly through the wearer's hair. Since in a hot environment the wearer's head is likely to be sweaty, the flow of air doubtless has a cooling effect, but the quality of the air provided for respiration is degraded by that action. Furthermore, the helmet shell taught by Dickey is not monolithic, but includes a separate piece covering the fan which provides sharply angled lips significantly away from the helmet's smooth surface. Such a cover is believed to create a significant risk of interference with nearby objects when the head is moved. Interference may impede a wearer's quick reaction or movements, particularly in close quarters, thus impairing safety. Such interference risk is thus contrary to a primary motivator for the present invention, which is to enhance wearer safety.

Thus, a need exists for a helmet which provides cooling air circulation around the wearer's head by drawing air across the wearer's head without obligating the wearer to breathe the air thus previously used for evaporating sweat, and particularly for such a helmet which also meets stringent impact-protection standards. Desirably, such a helmet would not have unnecessary protrusions to catch on objects near the wearer's head, and would be light and well-balanced, and thus would interfere minimally with the wearer's head movements. Ideally, such a helmet would also provide means for providing conditioned air to the wearer, where the conditioning might entail cooling, cleaning, or varying the gas mixture such as by adding or removing $H_2O$, $CO_2$, $O_2$ or other gases.

Accordingly, it is an object of the present invention to provide a helmet which cools the head by drawing gas across a wearer's head and then exhausting it outside the helmet It is a further object of the present invention to provide such a helmet which further meets stringent impact protection standards. It is a further object to provide a helmet as described, further having means to provide conditioned gas to the wearer. It is a further object to provide a helmet which interferes as little as possible with a wearer's head movements.

SUMMARY OF THE INVENTION

In one aspect, the present invention achieves some of the above objects by enclosing a fan assembly within a helmet, the fan assembly drawing ventilation air through channels which guide the air across the wearer's head and then exhaust it outside the helmet.

In another aspect, the present invention provides cooling air flow and also a high degree of impact protection.

In another aspect, the present invention provides a connection for externally conditioned air, channels to guide that air to the wearer's face, and exhausts air after it passes across the wearer's head.

In the preferred embodiment, the present invention employs a fan assembly that is small and light such that it can be nested in minimal space between a monolithic impact-resistant shell and a highly protective impact liner.

The compact nesting arrangement reduces undesirable protrusions and weight imbalances which could fatigue a wearer and interfere with his head movements. Electrical connection is provided to external electric power for the fan assembly, and provision is made for the user to engage a power conditioner to obtain a different fan speed than would otherwise be produced by the external supply. A gas inlet connection is provided for connecting an external source of air to the helmet, and channeling is provided to guide the externally-supplied air to the wearer's facial area for respiration and defogging. Thereby, the cleanliness, temperature and composition of the respiration and ventilation gas can be controlled.

A helmet according to the present invention is thought useful to any wearer requiring cooling of the head in addition to either conditioning of breathing gases or substantial impact protection. Thus, a helmet according to the present invention is thought useful for persons working in hot race cars, mines, agricultural or industrial environments, or hot environments having an atmosphere which is hazardous to breathe directly, and particularly when impact protection for the wearer's head is desired.

DETAILED DESCRIPTION OF THE DRAWINGS

Figure 1:
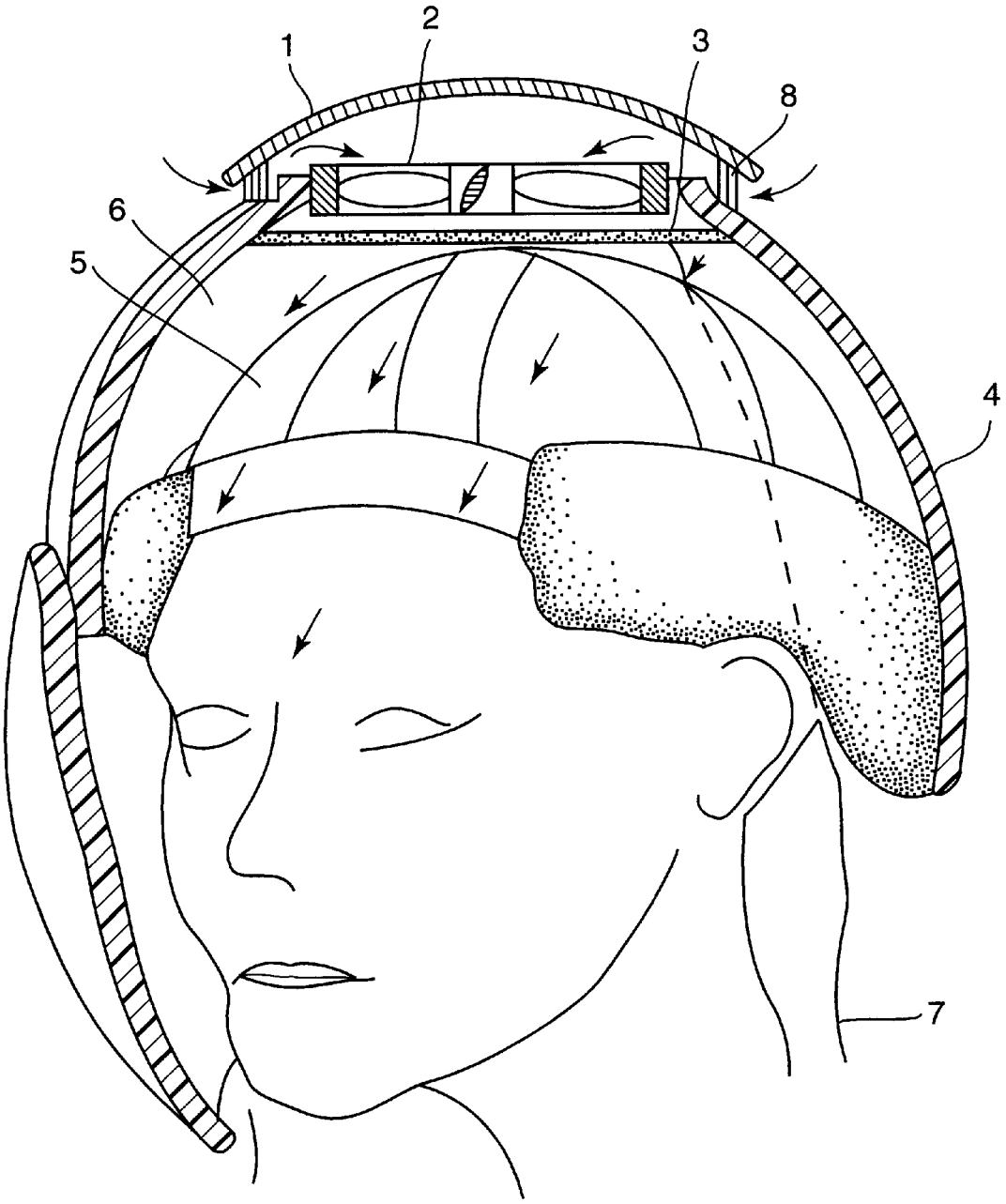
FIG. 1 PRIOR ART
FIG. 1 shows a helmet according to the prior art.

FIG. 1 shows a prior art helmet as disclosed in U.S. Pat. No. 5,113,853 to Dickey. There, helmet shell 4 surrounds fan 2 but does not enclose it. Rather, fan 2 is covered by cap 1, which is supported above the shell by fairly long stand-offs such as supporting member 8. Filter 3 removes particulates from the air. The helmet shell is supported away from the wearer's head by straps 5. Air flows in between cap 1 and shell 4, then through space 6 to reach the wearer's face. Wire 7 connects fan 2 to an external power source. Compared with the present invention, the prior art provides air for respiration only after it has passed over the wearers head, does not provide for attachment of an external source of air, provides inadequate impact lining, and provides a multiple-part outer shell including shell 4, cap 1 and standoffs 8 that is, at best, difficult to make adequately impact resistant so as to meet stringent impact safety standards.

Figure 2A:
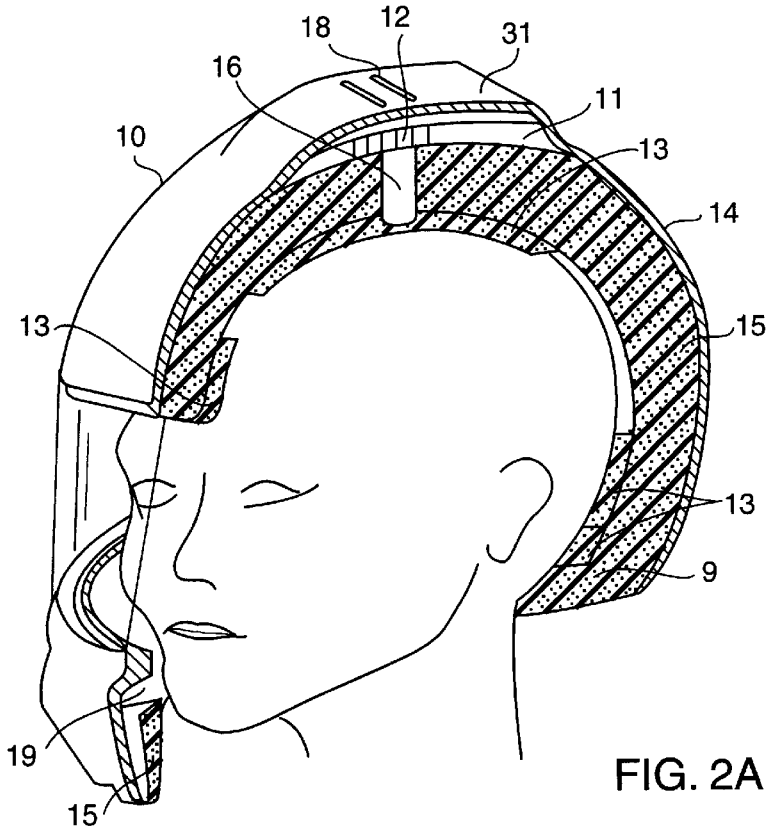
FIG. 2*a* is a cutaway view of a helmet embodying the present invention.

FIG. 2*a* shows helmet 10 according to the present invention. Fan assembly 45, comprising at least one fan 12 preferably mounted in cowling 11, is nested inside shell 14. In the preferred embodiment, fan assembly 45 is sandwiched between shell 14 and impact liner 15, and includes two fans. In embodiments incorporating impact liner 15, at least one air channel 16 extends through impact liner 15, and the preferred embodiment includes four air channels 16 extending through liner 15 to permit easy flow of air from inside the liner to fan assembly 45. Air exits the helmet through slots 18 in monolithic shell 14, the slots 18 being preferably located in helmet crown feature 31. In the preferred embodiment there are eight such slots, each being approximately 1.5 inches long and 0.125 inches wide. Padding liners 13 are preferably provided for the wearer's comfort, and reticulated to permit air to flow through them. Neck roll 9 is also primarily for comfort, but is typically made of a non-reticulated foam. If a piece of padding liner 13 is located at the crown of the wearer's head, as is preferred, then that piece of padding liner 13 must either be reticulated, have holes provided, or otherwise be arranged to permit air to flow toward fan assembly 45. Reticulation is preferred over holes because it permits air to flow from more directions.

Figure 2B:
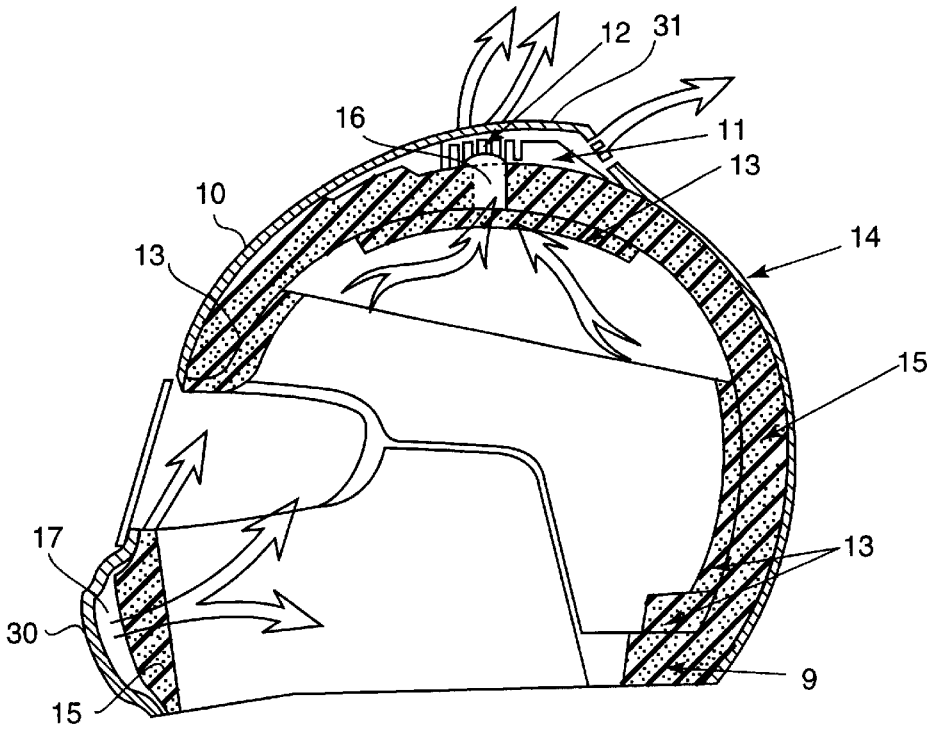
FIG. 2*b* is a cutaway view of the helmet showing air channels and flow.

Arrows in FIG. 2*b* depict air flowing up, preferably through padding liner 13 which is reticulated to permit air flow through it in all directions. The air then flows through at least one air channel 16, through at least one fan 12 which impels the air flow, and is exhausted from the helmet through at least one exit vent 18. It is preferred that two fans 12 be provided, and that four air channels 16 be provided in the region below the fans 12. In the preferred embodiment there are eight exit vents 18, located at the top and back of helmet crown feature 31, and taking the form of slots about 1.5 inches long by 0.125 inches wide. To maximize cooling air flow, the exhausted air should not be impeded by filters, and thus is substantially untreated in a preferred embodiment of the invention. It is also contemplated, however, that in some applications such filtering may be desirable despite the attendant reduction in air flow.

In the preferred embodiment, breathing gases are provided from an external source through attachment nipple 21 and channel feature 20 (FIG. 3*b*), and then through facial channel 17, formed between facial shell feature 30 and nearby impact liner 15. From channel 17, at least one opening 19 (FIG. 2*a*) is provided through adjacent impact liner 15, to pass the air to the wearer's facial area for breathing and cooling. The presently preferred embodiment contains two openings 19, each being an approximately square area of two square inches. Many arrangements of opening 19 are possible, but to produce a helmet providing the preferred high degree of impact protection sufficient impact liner should remain in the region to protect the wearer's mouth and jaw in the event of an impact. Openings 19 are preferably covered with a thin reticulated layer such as a net cloth (not shown).

Helmet shell 14 preferably has a smoothly faired monolithic construction, which not only enhances impact protection, but also gives the helmet aesthetic appeal. Moreover, such a helmet will be streamlined for minimal pressure from high speed air, and will not tend to catch on objects near the wearer's head. Construction of shell 14 into a single monolithic piece helps ensure the shell structural integrity.

Accordingly, shell 14 of helmet 10 is preferably smoothly faired over the bulk of the outer surface of shell 14, particularly away from the discontinuities inevitably presented by the terminating edge of helmet 10 at the bottom, nearest a wearer's neck. Helmet 10 preferably has crown feature 31 protruding beyond the ordinary contours of a helmet to enclose fan assembly 45 above impact liner 15. The surfaces covering fan assembly 45 are blended smoothly into the basic helmet shape. The portion of shell 14 which is transitional between the crown feature and the basic helmet shape provides the blending without creating sharp angles. For example, all surface tangent planes (where the helmet is contiguous), at points within 0.5 inch of each other, create an angle between 135 and 225 degrees. That is, surfaces close to each other are gently rounded, and are not more than 45 degrees from being straight.

Helmet shell 14 preferably includes a monolithic shell piece covering a majority of the wearer's head and also covering fan assembly 45. Radii from the center of the wearer's head through over half the surface of the wearer's head would pass through the same single piece of helmet shell. The preferred embodiment utilizes single monolithic shell piece 14. Items are added for strap attachment, visor attachment, and external air port attachment, but do not significantly reduce the coverage of the wearer's head by single monolithic shell piece 14.

The present invention preferably includes highly impact-absorbent impact liner 15 disposed inside the shell and covering over half the wearer's head. Air is extracted from inside impact liner 15 in the vicinity of the crown of the wearer's head, and exhausted outside the helmet The helmet is preferably constructed in accordance with, and meets the tests for, Snell 1995 Special Application Automotive Racing Standard for Helmets (SA-95). Such construction can be effected without employing a monolithic shell, as is well known by persons skilled in the art.

Shell 14 is preferably constructed from a thermoset resin filled with fiberglass or composite material, and has a thickness between 0.1 and 0.175 inch. Materials of this type are well known which, if used to construct a helmet as described herein, will enable the helmet to meet SA-95 standards. Of course, those practicing the invention may choose to do so with helmets not meeting this standard. Accordingly, numerous materials and construction techniques may be employed for practicing the present invention.

Impact liner 15 provides much of the protection necessary to meet stringent impact protection standards such as SA-95. The impact liner is preferably 1.2 to 1.5 inches thick. Any of several manufacturing techniques well known in the art may be employed with impact liner materials well known in the art to provide an impact liner within this thickness range which, in combination with shell 14 as described above, will enable the helmet to meet SA-95 standards as does the preferred embodiment.

Figure 3A:
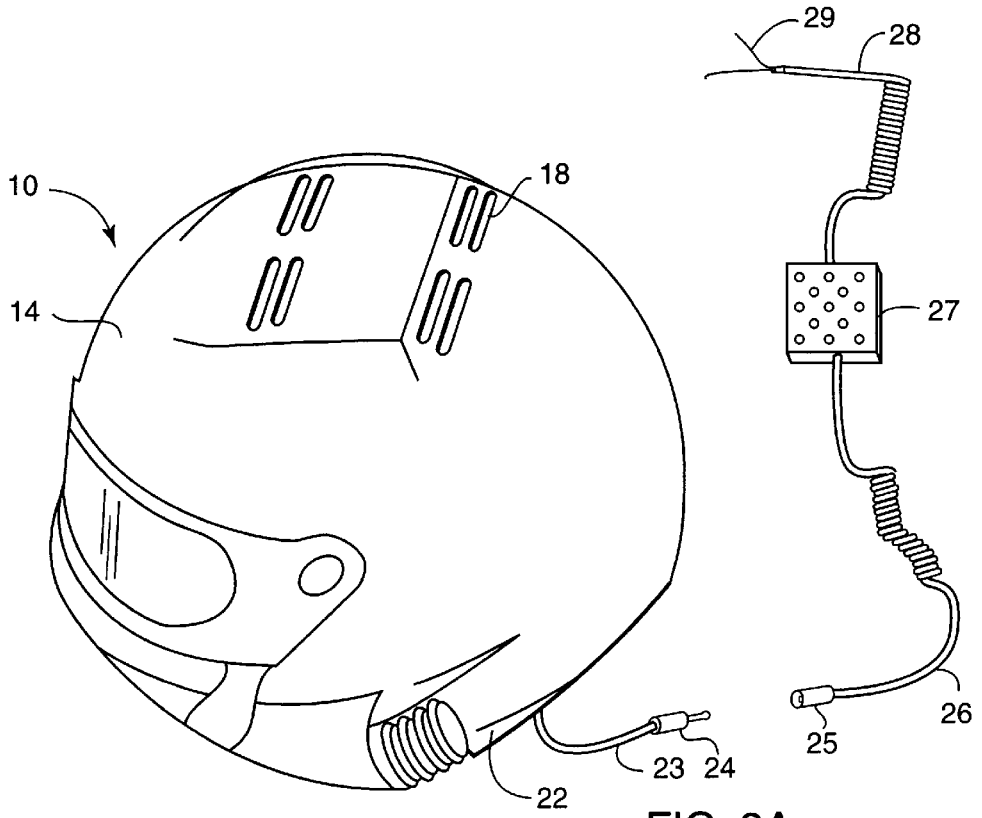
FIG. 3*a* is an outside view of the helmet showing electrical and air inlet connections.

FIG. 3*a* shows the eight exit vents 18 included in the preferred embodiment of helmet 10. These exit vents are each approximately 1.5 inches long and ⅛ inch wide, having a total area between 1 and 2 square inches. Screen mesh 44 (FIGS. 4*c*–4*d*) is preferably provided to cover the inside of vents 18 to impede flames and foreign objects from entering the helmet. This preferred arrangement of vents 18 provides adequately low resistance to air flow without unduly impairing the structural integrity or impact resistance of the shell. The long narrow profile of vents 18 helps impede entry of flames or foreign objects into the shell.

Electrical connection means are also shown, including cable 23 exiting helmet 10 between the impact liner and the shell in the vicinity of lower protective fin 22. Cable 23 preferably includes two 22 gauge finely stranded conductors, and has an outside diameter of approximately 5/32 inch. Cable 23 preferably connects to fan wires 41 between impact liner 15 and shell 14, at a point roughly 2.5 inches above the place where cable 23 exits from helmet 10. The end of cable 23, which is opposite the end connected to fan wires 41, terminates in connector 24. Connector 24 may be any convenient type of electrical connector having at least two connections, but is presently preferred to be an in-line miniature phone plug. Matching connector 25 is accordingly shown as presently preferred in-line miniature phone jack. Connecting cable 26 is preferably a coil-cord to provide flexibility of movement for the wearer. Cable 26 may terminate directly into wires 29 for attachment to a power source, or may attach first to power conditioner 27, which in turn reaches connecting wires 29 through second coil cord 28. Power conditioner 27 may regulate source power at a different voltage than the source, thus permitting not only the use of varying input source voltages, but also permitting changing of the fan speed by the expedient of selecting connection either to the source directly, or to one of many possible conditioners 27. The presently preferred conditioner boosts a 12 V source to 15 V. Many manufacturers produce DC-DC converters which can accomplish appropriate conditioning of the source power.

Figure 3B:
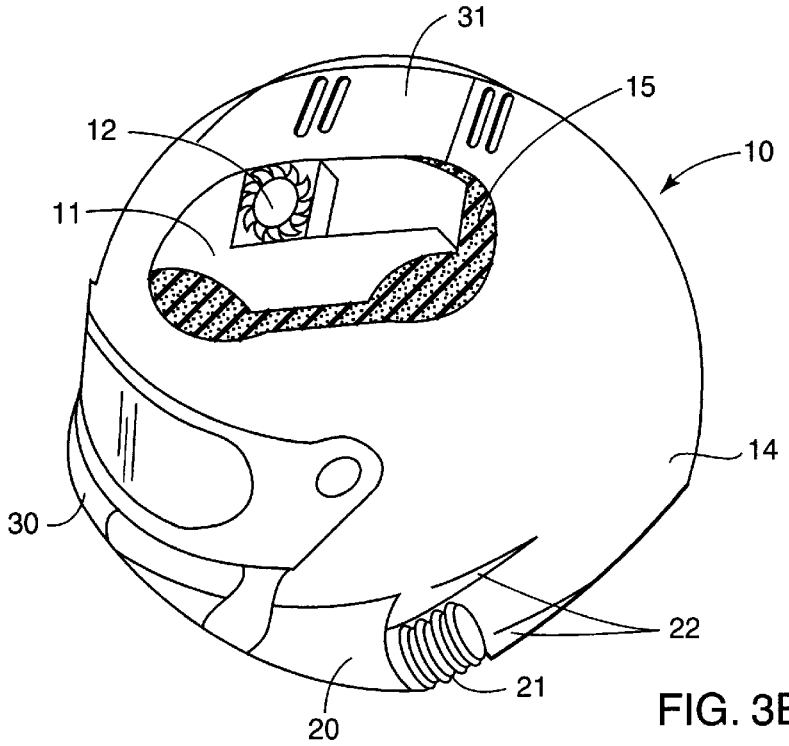
FIG. 3*b* shows fan and cowling nested in the helmet dome.

FIG. 3*b* shows air source attachment nipple 21 and protective fins 22, which are included in the preferred embodiment. The preferred embodiment includes two protective fins 22, one on either side of attachment nipple 21, which help prevent interference between an external source hose, not shown, and objects which a wearer may contact through head movements. These fins begin on either side of attachment nipple 21 where it exits channel feature 20, at that point protruding from the basic spherical contour of the shell by approximately 1.25 inches. They extend backwards, tapering smoothly in height until they merge with the basic spherical contour of the shell after about four inches. Where channel feature 20 meets protective fins 22, feature 20 extends about 1.5 inches above the ordinary spherical surface plane of the helmet From there, channel feature 20 tapers down smoothly over about 5 inches to merge into facial shell feature 30, which forms one side of facial channel 17 (FIG. 2*b*). The two channels form a duct between shell 14 and impact liner 15, which guides the externally supplied respiration gases from attachment nipple 21 toward the wearer's facial area.

Attachment nipple 21 is preferably tubular, extends approximately 1 inch beyond its exit from shell 14, and has tapered annular ridges to provide a friction grip for a slightly expandable tubular air hose (not shown) having an inside diameter of about 1.125 inches. The preferred attachment nipple is easily connected to and disconnected from, but a wide range of attachment shapes and sizes are well known in the art. This mechanism for attaching an external source of respiration gas allows any desired conditioning of the gases to be performed externally, thereby minimizing helmet complexity while maximizing performance flexibility.

FIG. 3*b* is partially cut-away to show fan 12 and cowling 11 nested above impact liner 15 and inside of crown feature 31 of shell 14. The minimal protrusion of crown feature 31 prevents undue interference between the helmet and objects around the wearer's head. The arrangement also keeps the weight of fan assembly 45 (the fans and cowling) at a minimum distance from the wearer's head, to minimize any balance problem which the weight of fan assembly 45 might otherwise cause for the wearer.

Figure 4A:
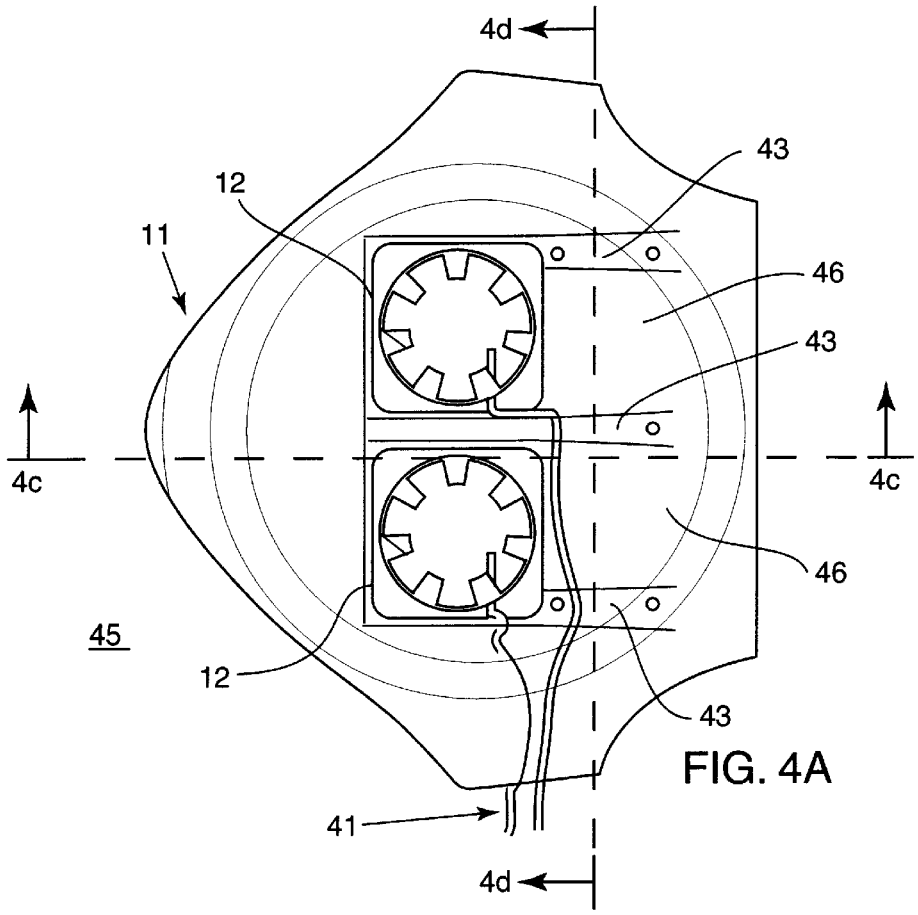
FIG. 4*a* is a top view of the fan cowling.

In the presently preferred embodiment, fan 12 is one of two identical fans, each a Papst 400 series brushless DC axial fan type 412FH. These fans operate from 6 to 15 volts, and each provide about 6 CFM of air flow at 12 V, or more if the source is conditioned to provide 15 V. Each fan is only 1.57×1.57×0.39 inches. Of course, different fans by different manufactures may be used in various arrangements, if desired. Preferably, however, fan assembly 45, which includes all fans provided, should be small enough to be nested between shell 14 and impact liner 15 without requiring a large protrusion in shell 14 to excessively risk interference with nearby objects, and should not require reduction in the thickness of impact liner 15 in such a way as to significantly impair impact protection. Any fan or fans used should not add excessive weight FIG. 4*a* shows the preferred embodiment of fan assembly 45. Both fans 12 are mounted in cowling 11. Fans 12 are attached to an external source of power through fan lead wires 41. Ridges 43 form channels 46, which help conduct gas from fans 12 to exit vents 18 at the rear of crown feature 31 (FIGS. 2*a*–2*b*).

Figure 4B:
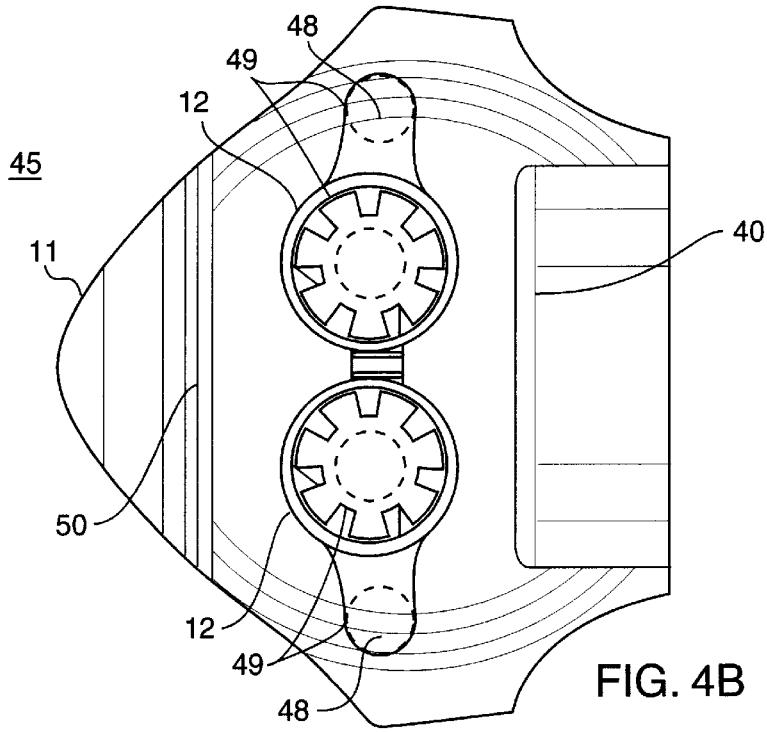
FIG. 4*b* is a bottom view of the fan cowling.

In FIG. 4*b*, ridge 40 runs laterally behind fans 12, and ridge 50 runs laterally in front of fans 12. Ridges 40 and 50 restrain cowling 11 against impact liner 15. Channels 48 provide ducting for air passing through holes 16 (FIG. 2*b*) in impact liner 15 to reach fans 12. Items 49 do not exist in the helmet embodiment, but are merely circles drawn to show the preferred location of holes 16 through impact liner 15, relative to fan assembly 45. In the assembled helmet, impact liner 15 is adjacent the bottom of fan assembly 45.

Figure 4C:
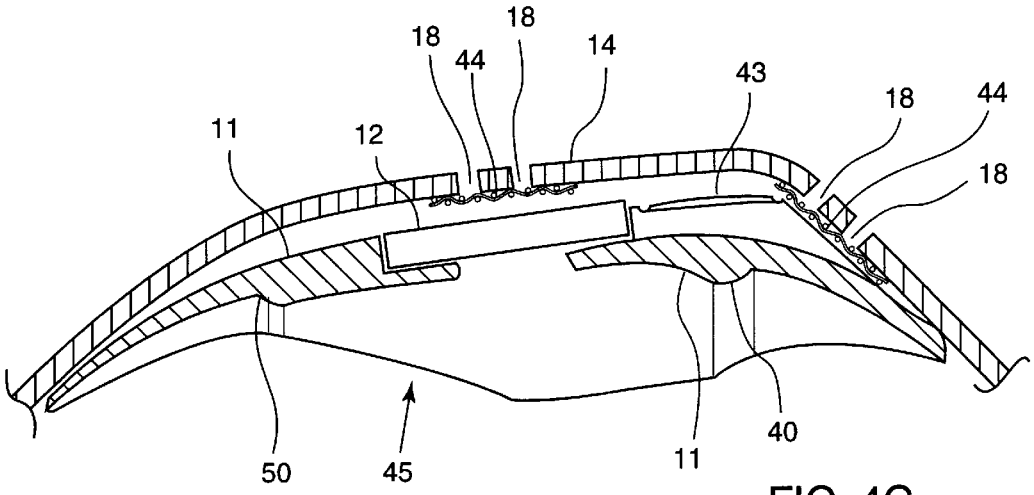
FIG. 4*c* is a side sectional view of the fan cowling and a portion of the shell.

FIG. 4*c* provides a view from section 4*c*—4*c* of FIG. 4*a*, along with a portion of a section of helmet shell 14 taken at the same plane, revealing the relationship between shell 14, fans 12 and cowling 11 in the preferred embodiment. The cross hatching of the cowling material at section 4*c*—4*c* reveals the cross sectional shape of ridges 40 and 50. FIG. 4*c* also shows the general curved nature of the cowling, which is necessary to facilitate sandwiching between helmet shell 14 and rounded impact liner 15 (FIGS. 2*a*–2*b*). The shape of ridge 43 is also seen, which creates channels 46. Two vents 18 are shown traversing shell 14 above fans 12, and two more vents 18 are shown traversing shell 14 behind channels 46. Preferably, screen 44 made of brass wire mesh in a grid of about 0.07 inch spacing is disposed on the inside of shell 14 below each group of vents 18. Screens 44 not only prevent foreign objects from reaching fans 12, but more importantly prevent flames from entering the helmet. Preventing entry into shell 14 of objects or flames is one reason for the narrow openings which are preferred for vents 18.

Figure 4D:
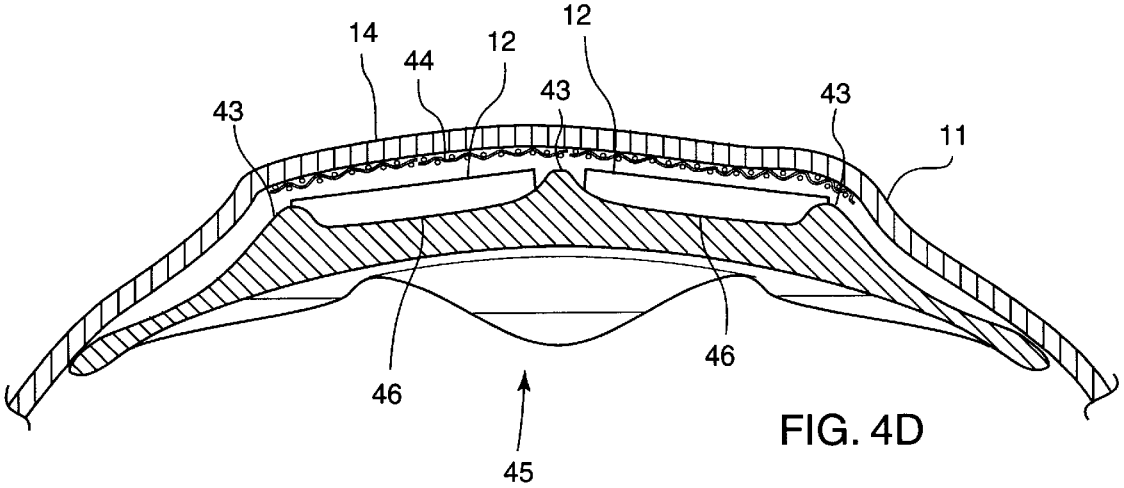
FIG. 4*d* is a rear sectional view of the fan cowling and a portion of the shell.

FIG. 4*d* fans 12, cowling 11, and a portion of helmet shell 14 from the plane indicated by section 4*d*—4*d* of FIG. 4*a*. As above, the cowling cross hatching shows the actual material of cowling 11 at the section. Channels 46 formed by ridges 43 are more easily seen in this view. Screen 44 is preferably placed in a single piece across the openings of a group of vents 18 (FIG. 4*c*), and held in place against shell 14 with a bead of epoxy resin, or similar adhesive (not shown), disposed around the perimeter of mesh 44.

It will be appreciated by those skilled in the art that the construction details shown for cowling 11 are not essential. The cowling preferably captures fans 12 and positions them securely adjacent the helmet shell and outside the impact liner. Since alternative fans and fan arrangements may be selected by those practicing the present invention, a cowling and shell for such different fans may have to be differently constructed from the present cowling 11. It is preferred to keep the space absorbed by fan assembly 45 (fans 12 and cowling 11) small in order to prevent fan assembly 45, and the shell covering it, from being heavy, bulky, impact-susceptible, or likely to interfere with nearby objects. Alternatively, a cowling may be omitted and the at least one fan 12 could be installed instead in a feature formed in shell 14 or liner 15. However, such an embodiment is not preferred because of the inconvenience of establishing such a piece which would retain the high degree of impact protection desired

OTHER EMBODIMENTS

Having described the invention in connection with a preferred embodiment thereof, modification may now suggest itself to those skilled in the art. For example, for use in an environment in which gases exiting the helmet must be filtered, filtering could be provided by a modified comfort pad 13 covering air channel(s) 16, or by placing filtering in air channel(s) 16 or under exit vents 18. If filtering of the incoming air is needed, filters could be provided by modifying comfort pad 13 covering facial air channel(s) 19, or filters could be placed in air channels 19 or 20 or in attachment nipple 21. As such, the invention is not to be limited to the disclosed embodiments except as required by the appended claims.

What is claimed is:

1. A protective helmet having:

an impact-resistant outer shell;

an impact liner disposed within the outer shell and enclosing a substantial portion of a wearer's head;

a fan assembly, having at least one fan, disposed between the impact liner and the outer shell near vents opening in the outer shell; and a connection for applying electrical power to said fan;

wherein the fan assembly is oriented such that when connected to electrical power by properly employing said connection, the fan assembly draws gases from inside the helmet and exhausts the gases through the vents opening in the outer shell.

2. A helmet according to claim 1, in which the fan assembly includes a plurality of fans and is disposed radially from a crown of the wearer's head and adjacent the outer shell.

3. A helmet according to claim 1, further comprising a connection assembly for connecting the fan assembly to an external source of electric power, the connection assembly including a power conditioner for modifying the electrical power supplied to the fan assembly from the external source.

4. A helmet according to claim 1 in which the impact liner covers a majority of the wearer's head, and the helmet is constructed in compliance with Snell 1995 Special Application Standard for Protective Headgear.

5. A helmet according to claim 1, further including a gas attachment port for removably connecting an external source of breathing gas to the helmet.

6. A helmet according to claim 4, further comprising:

reticulated comfort padding between the wearer's head and the impact liner;

a gas connector for removably connecting an external source of gas;

at least one source channel to guide gas from an interface of the gas connector into the helmet, to an area near a face of the wearer;

at least one exhaust channel to conduct gas from near a crown of the wearer's head to the fan assembly, the fan assembly including a plurality of electrically driven fans restrained in a fan cowling adjacent the outer shell.

7. A protective helmet comprising:

a fan assembly including at least one fan;

a connection for applying electrical power to said at least one fan;

a smoothly faired and impact-resistant outer shell including a single monolithic piece which covers a majority of a wearer's head and also covers the fan assembly;

wherein the fan assembly, when connected to appropriate electrical power through said connection, is so oriented as to drawls gases from inside the helmet near the crown of the wearer's head and exhaust the gas through vents in the outer shell.

8. A helmet according to claim 7 in which the gas drawn from inside the helmet is substantially untreated before exhaustion into ambient gas surrounding the helmet.

9. A helmet according to claim 7, further comprising:

a connection assembly for connecting the fan assembly to an external source of electric power, the connection assembly including a power conditioner for modifying the electrical power supplied to the fan assembly from the external source.

10. A helmet according to claim 7, further comprising an impact liner disposed within the outer shell and covering a majority of the wearer's head, wherein the helmet is constructed in compliance with Snell 1995 Special Application Standard for Protective Headgear.

11. A helmet according to claim 7, further comprising a gas attachment port for removably connecting an external source of breathing gas to the helmet.

12. A helmet according to claim 11 in which the fan assembly includes a plurality of fans mounted in a cowling disposed between the shell and a liner for restraining the wearer's head which is located near a crown of the wearer's head.

13. A method of providing head protection and cooling, comprising the steps of:

providing a helmet shell having an impact resistant outer shell with a crown feature near the crown of the helmet;

providing a fan assembly entirely within the helmet shell, fitting between the crown feature of the helmet shell feature and an impact liner;

providing at least one opening through the impact liner;

disposing the impact liner in the helmet shell with an exterior toward the shell and an interior toward a center of the helmet, with the at least one opening through the impact liner providing fluid communication between the fan assembly and the interior of the impact liner; and operating the fan assembly to draw gas from within the helmet adjacent a wearer's head and to exhaust the gas outside the helmet.

14. A method of providing head protection and cooling according to claim 13 in which the step of operating the fan assembly includes exhausting gas from a portion of the outer shell near the crown feature of the helmet.

15. A method of providing head protection and cooling according to claim 13 in which the step of operating the fan assembly includes exhausting respiration gases from inside the helmet which are essentially unimpeded by any filtering.

16. A method of providing head protection and cooling according to claim 13 in which the step of providing a fan assembly includes providing a plurality of electric fans, and further comprising the step of connecting the fans to a source of electric power through a connector.

17. A method of providing head protection and cooling according to claim 13 in which the step of operating the fan assembly includes a step of performing selected conditioning upon power from an external source and connecting power thus conditioned to the fans.

18. A method of providing head protection and cooling according to claim 13 in which the helmet is constructed in compliance with Snell 1995 Special Application Standard for Protective Headgear.

19. A method of providing head protection and cooling according to claim 13, further including the steps of:

providing a respiration gas connector attached to the helmet;

connecting an external source of respiration gas to the helmet through the gas connector; and guiding the externally sourced respiration gas to a region of the wearer's face.

20. A method of providing head protection and cooling according to claim 13 in which the step of providing a helmet shell includes providing a single monolithic piece of impact-resistant material which covers a majority of the wearer's head and also covers the fan assembly.

21. A method of manufacturing a ventilated protective helmet, comprising the steps of:

providing an impact resistant helmet shell;

disposing an impact liner between an anticipated location of a wearer's head and the helmet shell over a majority of the helmet shell area, including between a fan assembly and the anticipated location of the wearer's head;

providing a fan assembly entirely within the shell to fit between the helmet shell and the impact liner, oriented so as to draw air from an impact liner side of the assembly towards a helmet shell side of the assembly; and providing means for connecting the fan assembly to a source of electrical power such that, in use when properly connected to a source of power, the fan assembly will draw gas from within the helmet, including across at least a portion of the wearer's head, and then exhaust the gas outside the helmet shell.

22. A method of manufacturing a helmet according to claim 21 including the further step of providing a path for respiration gases to flow from inside the impact liner, through the fan assembly and then outside the helmet without passing through significant filtering.

23. A method of manufacturing a helmet according to claim 21 in which:

the step of providing a fan assembly includes providing a plurality of electric fans; and the step of providing a means for connecting the fans to a source of electric power includes providing at least one connector having a power conditioner for modifying the power delivered to the fan assembly, such that in use a wearer may selectively condition the power provided to the fan assembly.

24. A method of manufacturing a helmet according to claim 21 in which the helmet is constructed in compliance with Snell 1995 Special Application Standard for Protective Headgear.

25. A method of manufacturing a helmet according to claim 21, further including the steps of:

providing a respiration gas connector attached to the helmet for connection to an external source of respiration gases; and providing ducts guiding the externally sourced respiration gas to a region of the wearer's face.

* * * * *